US008016278B2

(12) United States Patent
Dixon

(10) Patent No.: US 8,016,278 B2
(45) Date of Patent: Sep. 13, 2011

(54) CAM ACTUATED CLAMP

(75) Inventor: Robert D. Dixon, Everett, WA (US)

(73) Assignee: The Boeing Company, Chicago, IL (US)

( * ) Notice: Subject to any disclaimer, the term of this patent is extended or adjusted under 35 U.S.C. 154(b) by 587 days.

(21) Appl. No.: 12/211,958

(22) Filed: Sep. 17, 2008

(65) Prior Publication Data

US 2010/0066001 A1 Mar. 18, 2010

(51) Int. Cl.
*B25B 1/00* (2006.01)

(52) U.S. Cl. ..... 269/156; 269/6; 269/229; 269/236; 29/257; 29/270; 29/278

(58) Field of Classification Search ..... 269/156, 269/236, 254 CS, 3, 6, 95, 229, 249, 149; 29/244, 267, 270, 278, 257, 276
See application file for complete search history.

(56) References Cited

U.S. PATENT DOCUMENTS 5,863,033 A * 1/1999 Bradford ..... 269/3
6,000,686 A * 12/1999 Yates ..... 269/6
6,161,823 A * 12/2000 Bradford ..... 269/3
6,665,919 B1 * 12/2003 Kurtz et al. ..... 29/262
6,742,415 B2 * 6/2004 Scott ..... 81/15.9
6,832,416 B2 * 12/2004 Dixon ..... 24/536
7,272,878 B2 * 9/2007 Dixon ..... 29/263
7,950,122 B2 * 5/2011 Saylor ..... 29/268
2010/0066001 A1 * 3/2010 Dixon ..... 269/236

* cited by examiner

*Primary Examiner* — Lee D Wilson
(74) *Attorney, Agent, or Firm* — Dennis R. Plank

(57) ABSTRACT

A clamp including an upper body including a proximal end, a distal end, and an upper fulcrum, the upper fulcrum being positioned between the proximal end and the distal end of the upper body, wherein the distal end of the upper body includes an upper jaw, a lower body including a proximal end, a distal end, and a lower fulcrum, the lower fulcrum being positioned between the proximal end and the distal end of the lower body, wherein the distal end of the lower body includes a lower jaw, an edge pusher having an upper projection pivotally engaged with the upper fulcrum and a lower projection pivotally engaged with the lower fulcrum, an actuating lever pivotally connected to the upper body, the actuating lever including a cam lobe moveable relative to the lower body to displace the proximal end of the lower body away from the proximal end of the upper body, and a biasing element positioned to bias the upper jaw away from the lower jaw.

24 Claims, 5 Drawing Sheets

CAM ACTUATED CLAMP

FIELD

The present patent application is directed to clamps and, more particularly, to cam actuated clamps and, even more particularly, to cam actuated clamps configured to apply a clamping force to a workpiece, as well as a pushing force to the edge of the workpiece in a direction generally perpendicular to the clamping force.

BACKGROUND

The construction of commercial aircraft requires adhering large lengths of plastic trim pieces to the edges of interior panels. Typically, tape, such as masking tape, is used to hold the trim to the edges while the adhesive applied therebetween cures. However, the use of masking tape is time consuming and has presented several disadvantages, including (1) inconsistent application/holding pressures resulting in wavy trim strips, (2) soft tissue injuries stemming from the repetition of applying force to the tape, and (3) excess adhesive deposits on the trim that are difficult to remove.

As an alternative to tape, aircraft manufacturers have also used clamps for holding the trim in place during adhesive curing. A typical clamp may include a first jaw pivotally connected to a second jaw and a biasing device positioned relative to the jaws to bias the jaws to the clamped configuration. However, like tape, prior art clamps also present certain disadvantages. For example, prior art clamps generally require significant physical effort to overcome the force of the biasing device during application and removal of the clamps. Therefore, repetitive use of such clamps may be time consuming and may significantly contribute to operative fatigue. Furthermore, prior art clamps generally do not hold the trim against the edge under pressure.

Accordingly, there is a need for a clamp that reduces application time, requires less physical effort by workers to use, and applies a pushing force capable of urging trim into contact with the associated edge.

SUMMARY

In one aspect, the disclosed cam actuated clamp may include an upper body including a proximal end, a distal end, and an upper fulcrum, the upper fulcrum being positioned between the proximal end and the distal end of the upper body, wherein the distal end of the upper body includes an upper jaw, a lower body including a proximal end, a distal end, and a lower fulcrum, the lower fulcrum being positioned between the proximal end and the distal end of the lower body, wherein the distal end of the lower body includes a lower jaw, an edge pusher having an upper projection pivotally engaged with the upper fulcrum and a lower projection pivotally engaged with the lower fulcrum, an actuating lever pivotally connected to the upper body, the actuating lever including a cam lobe moveable relative to the lower body to displace the proximal end of the lower body away from the proximal end of the upper body, and a biasing element positioned to bias the upper jaw away from the lower jaw.

In another aspect, the disclosed cam actuated clamp may include an upper body including a proximal end, a distal end, and an upper fulcrum, the upper fulcrum being positioned between the proximal end and the distal end of the upper body, wherein the distal end of the upper body includes an upper jaw, a lower body including a proximal end, a distal end, and a lower fulcrum, the lower fulcrum being positioned between the proximal end and the distal end of the lower body, wherein the distal end of the lower body includes a lower jaw, an edge pusher having an upper projection and a lower projection, the upper projection being pivotally engaged with the upper fulcrum and the lower projection being pivotally engaged with the lower fulcrum, an actuating lever pivotally connected to the upper body, the actuating lever including a cam lobe moveable relative to the lower body to displace the proximal end of the lower body away from the proximal end of the upper body, and a coil spring connected to the upper body and the lower body to bias the upper jaw away from the lower jaw, wherein the coil spring applies a pushing force to the edge pusher when the proximal end of the lower body is displaced away from the proximal end of the upper body.

In another aspect, the disclosed cam actuated clamp may include an upper body including a proximal end, a distal end, an upper fulcrum and an upper spring connection post, the upper fulcrum having a first ramped portion and being positioned between the proximal end and the distal end of the upper body, wherein the distal end of the upper body includes an upper jaw, wherein the proximal end of the upper body includes a first notch, a lower body independent of the upper body, the lower body including a proximal end, a distal end, a lower fulcrum and a lower spring connection post, the proximal end of the lower body defining a cam surface, the lower fulcrum including a second ramped portion and being positioned between the proximal end and the distal end of the lower body, wherein the distal end of the lower body includes a lower jaw an edge pusher independent of the upper body and the lower body, the edge pusher including a front face, a rear face, an upper projection, a lower projection and a second notch, the upper projection being pivotally engaged with the upper fulcrum and the lower projection being pivotally engaged with the lower fulcrum; an actuating lever pivotally connected to the upper body such that at least a portion of the actuating lever is moveable through the first notch and the second notch, the actuating lever including a cam lobe moveable relative to the cam surface to displace the proximal end of the lower body away from the proximal end of the upper body; and a coil spring having a first end and a second end, the first end being connected to the upper connection post and the second end being connected to the lower connection post, wherein the coil spring applies a pushing force to the rear face of the edge pusher when the proximal end of the lower body is displaced away from the proximal end of the upper body.

In another aspect, the disclosed cam actuated clamp may be used to secure a first body against an edge of a second body by positioning the second body between the upper jaw and the lower jaw of the clamp, positioning the first body between the edge of the second body and the edge pusher of the clamp, and actuating the lever such that the upper jaw and the lower jaw approximate to apply a clamping force to the second body, while, simultaneously, the edge push is advanced to apply a pushing force to the first body.

Other aspects of the disclosed cam actuated clamp will become apparent from the following description, the accompanying drawings and the appended claims.

DETAILED DESCRIPTION

Figure 1:
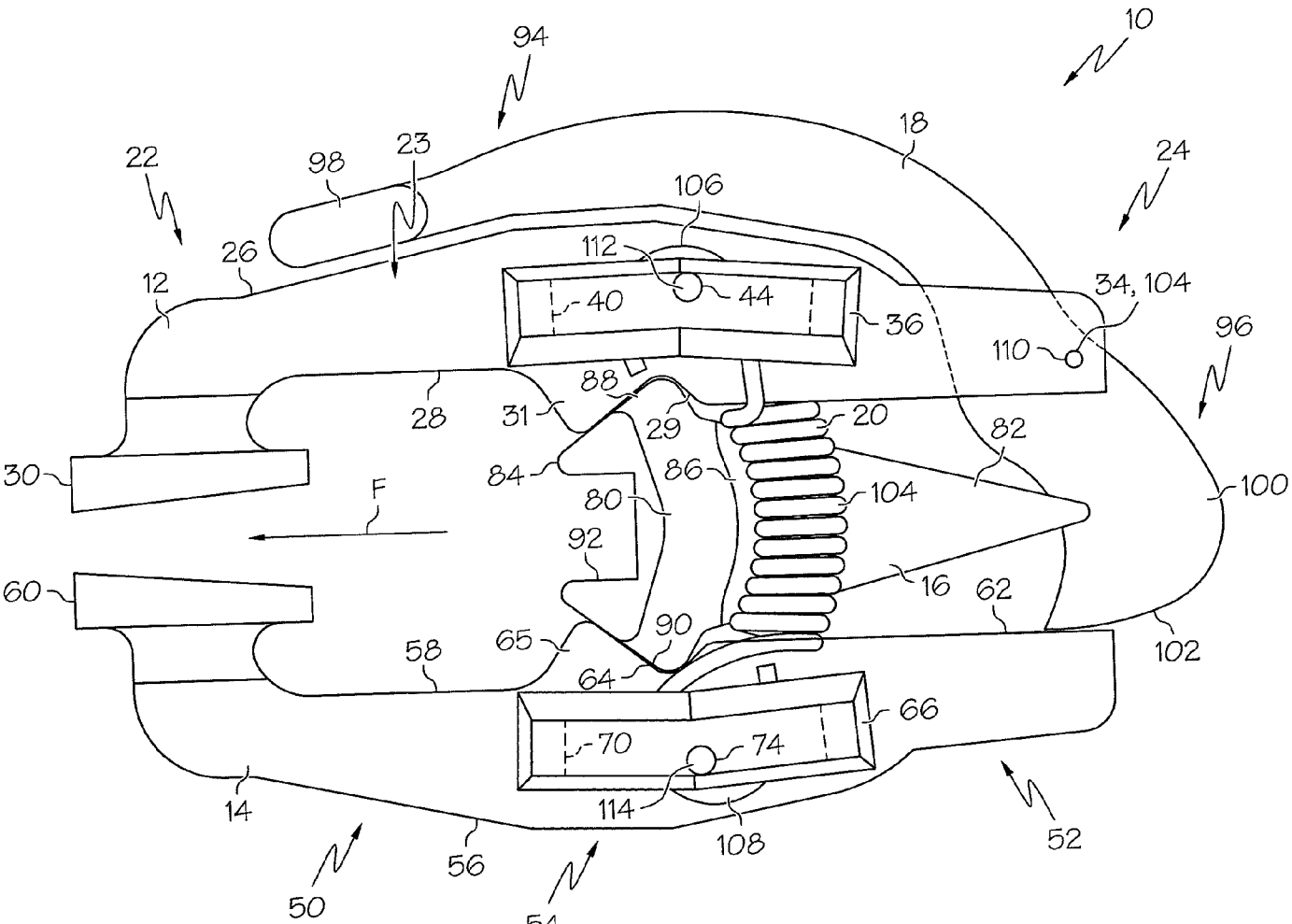
FIG. 1 is a side elevational view of one aspect of the disclosed cam actuated clamp in an engaged configuration.

Referring to FIG. 1, one aspect of the disclosed cam actuated clamp, generally designated 10, may include an upper body 12, a lower body 14, an edge pusher 16, an actuating lever 18 and a biasing element 20. The clamp 10 may be formed from any appropriate material and in any appropriate sizes, shapes and configurations. For example, the components of the clamp 10, particularly the upper 12 and lower 14 body, the edge pusher 16, the actuating lever 18 and the biasing element 20, may be formed from polymeric materials (e.g., nylon), metallic materials (e.g., steel), composite materials, natural materials, synthetic materials, or combinations thereof.

The biasing element 20 may bias the clamp 10 to the disengaged configuration shown in FIG. 6, and movement of the actuating lever 18 relative to the upper and lower bodies 12, 14 may actuate the clamp 10 to apply a clamping force and, optionally, a pushing force to a workpiece (e.g., the trim 204 connected to the workpiece 200 shown in FIG. 7), as will be described in greater detail herein.

Figure 2:
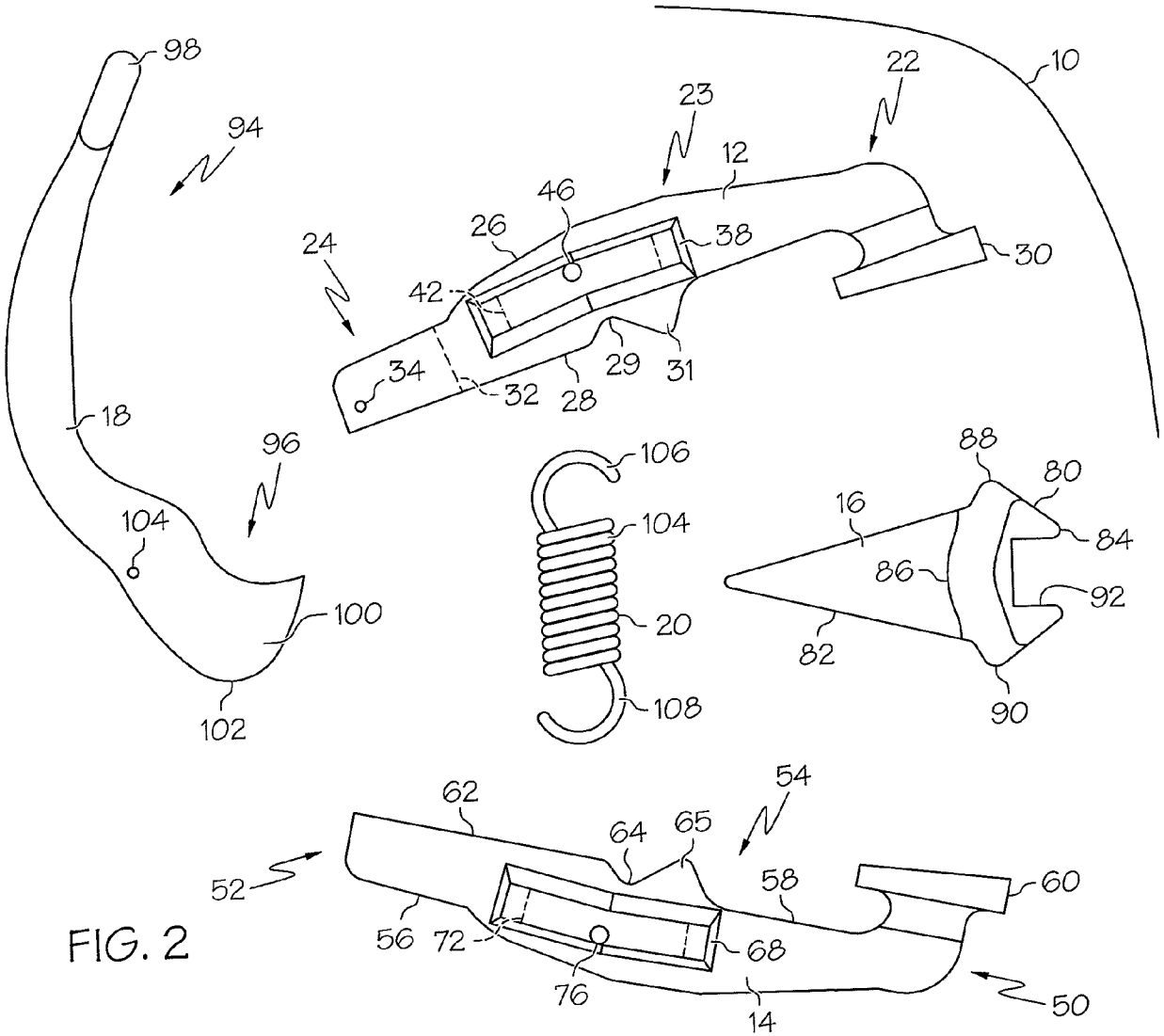
FIG. 2 is an exploded, side elevational view of the cam actuated clamp of FIG. 1.
Figure 3:
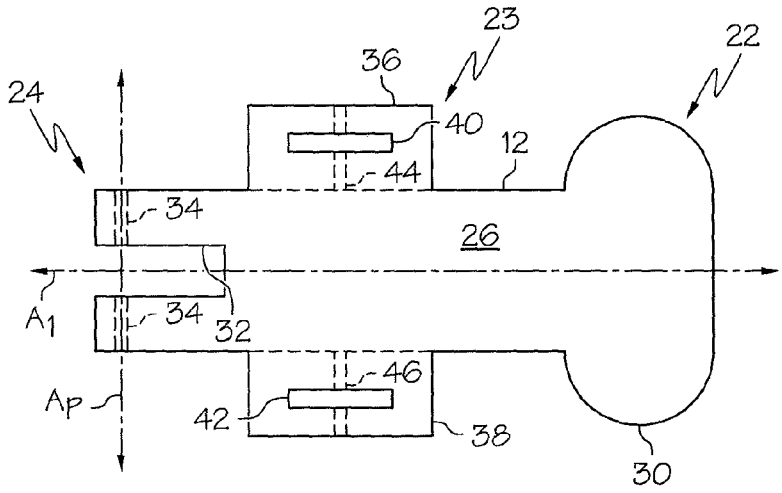
FIG. 3 is a top plan view of the upper body of the cam actuated clamp of FIG. 1.

Referring to FIGS. 2 and 3, the upper body 12 may be generally planar and elongated along a central axis $A_1$ (FIG. 3) and may include a distal end 22, a proximal end 24, a central portion 23 between the distal end 22 and the proximal end 24, an outer surface 26, and an inner surface 28. The distal end 22 may include an upper jaw 30 formed thereon or connected thereto. The proximal end 24 may include a notch 32 formed therein. The notch 32 may be positioned in the center of the proximal end 24 and may be generally axially aligned with the central axis $A_1$, thereby providing the proximal end 24 of the upper body 12 with a fork-like shape. Furthermore, the proximal end 24 may include a pin hole 34 extending therethrough, generally perpendicular to the central axis $A_1$, to define a pivot axis $A_P$.

Referring to FIG. 2, the inner surface 28 of the upper body 12 may include an upper fulcrum 29 formed therein. Optionally, the upper fulcrum 29 may be at least partially defined by a ramped portion 31 at a distal end of the fulcrum 29. The upper fulcrum 29 may be positioned in the central portion 23 of the upper body 12 and may be formed as a V- or U-shaped channel, a notch, a depression, a socket or the like. Furthermore, the upper fulcrum 29 may be positioned at a single point or location on the central portion 23, or may extend across the width of the central portion 23, either partially or entirely, generally parallel with the pivot axis $A_P$ (FIG. 3).

Referring again to FIGS. 2 and 3, the central portion 23 of the upper body 12 may also include a first spring connection post 36 extending outward (e.g., aligned with pivot axis $A_P$) from the upper body 12 in a first direction and a second spring connection post 38 extending outward (e.g., aligned with pivot axis $A_P$) from the upper body 12 in a second, opposite direction. Each post 36, 38 may include a corresponding slot 40, 42 and a pin hole 44, 46 for securely connecting the biasing element 20 thereto.

Figure 4:
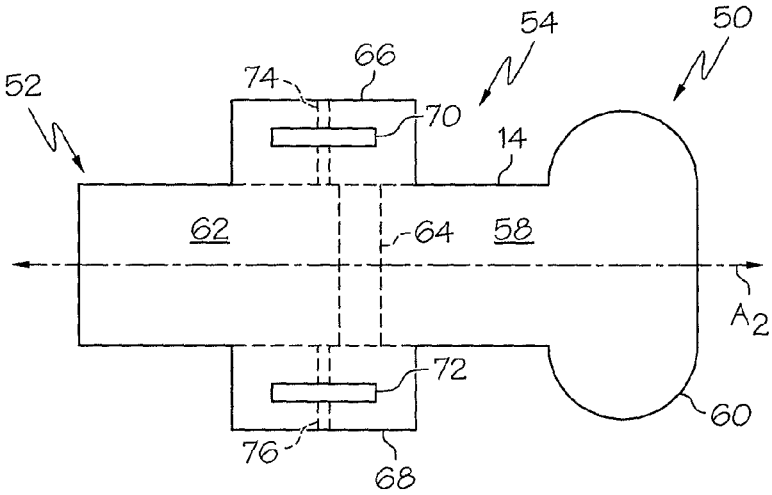
FIG. 4 is a top plan view of the lower body of the cam actuated clamp of FIG. 1.

Referring to FIGS. 2 and 4, the lower body 14 may be generally planar and elongated along a central axis $A_2$ (FIG. 4) and may include a distal end 50, a proximal end 52, a central portion 54 between the distal end 50 and the proximal end 52, an outer surface 56, and an inner surface 58. The distal end 50 may include an upper jaw 60 formed thereon or connected thereto. The proximal end 52 may include a cam surface 62 formed on the inner surface 58 thereof.

The inner surface 58 of the lower body 14 may include a lower fulcrum 64 formed therein. Optionally, the lower fulcrum 64 may be at least partially defined by a ramped portion 65 at a distal end of the fulcrum 64. The lower fulcrum 64 may be positioned in the central portion 54 of the lower body 14 and may be shaped as a V- or U-shaped channel, a notch, a depression, a socket or the like. Furthermore, the lower fulcrum 64 may be positioned at a single point or location on the lower body 14, or may extend across the width of the central portion 54, either partially or entirely, generally parallel with the pivot axis $A_P$ (FIG. 3).

The central portion 54 of the lower body 14 may also include a first spring connection post 66 extending outward (e.g., aligned with pivot axis $A_P$) from the lower body 14 in a first direction and a second spring connection post 68 extending outward (e.g., aligned with pivot axis $A_P$) from the lower body 14 in a second, opposite direction. Each post 66, 68 may include a corresponding slot 70, 72 and a pin hole 74, 76 for securely connecting the biasing element 20 thereto.

While the upper 30 and lower 60 jaws are shown in FIGS. 3 and 4 as having a generally obround shape if top view, those skilled in the art will appreciate that the jaws 30, 60 may be formed in various shapes and sizes depending upon the intended application of the clamp 10. Additionally, while not shown in the drawings, the upper 30 and/or lower 60 jaws may include various gripping features, such as a higher friction or textured surface, a padded surface, a magnetic surface or the like.

Figure 5:
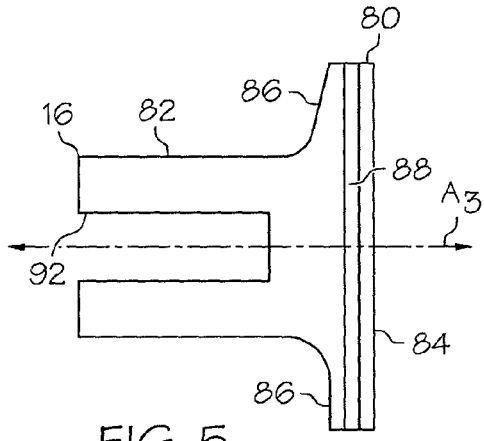
FIG. 5 is a top plan view of the edge pusher of the cam actuated clamp of FIG. 1.

Referring to FIGS. 2 and 5, the edge pusher 16 may define a central axis $A_3$ and may include a distal end 80 and a proximal end 82. The distal end 80 may include a front face 84, a rear face 86, an upper pivot projection 88 and a lower pivot projection 90. In one aspect, the front face 84 may include a notch 92 for receiving a straightedge therein. (See straightedge 202 in FIG. 7.) However, those skilled in the art will appreciate that a straightedge may be integral with the front face 84. Furthermore, those skilled in the art will appreciate that the front face 84 (or straight edge 202) may be sized and shaped (e.g., curved) in various ways. For example, the front face 84 (or straight edge 202) may be sized and shaped to correspond to the size and shape of the workpiece to be engaged by the clamp 10. (See trim 204 on workpiece 200 in FIG. 7.)

The rear face 86 may be generally aligned with, but on an opposite side of, the front face 84 and may serve as a transition between the distal 80 and proximal 82 ends of the edge pusher 16. In one aspect, as shown in FIG. 2, the rear face 86 may be partially curved in side view (FIG. 2) to engage the biasing element 20, as shown in FIG. 1 and discussed herein. Those skilled in the art will appreciate that the radius of curvature of the rear face 86 is a design consideration and may be dependent upon the overall size of the clamp 10.

Referring to FIG. 2, the upper pivot projection 88 may extend outward from the distal end 80 in a first direction generally perpendicular to the central axis $A_3$ of the edge pusher 16 and the lower pivot projection 90 may extend outward from the distal end 80 in a second, opposite direction. The upper 88 and lower 90 pivot projections may be positioned at a single point or location on the distal end 80 (e.g., a pivot post), or may extend across the width of the distal end 80 of the edge pusher 16 (e.g., as a ridge), either partially or entirely, such that the pivot projections 88, 90 are generally parallel with the pivot axis $A_P$ (FIG. 3). The upper pivot projection 88 may be sized and shaped to pivotally engage the upper fulcrum 29 in the upper body 12 and the lower pivot projection 90 may be sized and shaped to pivotally engage the lower fulcrum 64 in the lower body 14. The engagements between the pivot projections 88, 90 and the fulcrums 29, 64 when the clamp 10 is in the assembled configuration (FIG. 1) may be ball-and-socket-type engagements.

Referring again to FIGS. 2 and 5, the proximal end 82 of the edge pusher 16 may be tapered (FIG. 2) and may include a notch 92 (FIG. 5) formed therein. The notch 92 may be positioned to align with the notch 32 in the proximal end 24 of the upper body 12. For example, the notch 32 may be centered in the proximal end 82 and may be generally axially aligned with the central axis $A_3$ of the edge pusher 16, thereby providing the proximal end 82 of the edge pusher 16 with a fork-like shape. As shown in FIG. 6, the extent of the taper (i.e., the taper angle) of the proximal end 82 may dictate the spacing of the upper 30 and lower 60 jaws when the clamp 10 is in the disengaged configuration.

Referring to FIG. 2, the actuating lever 18 may include a first end 94 and a second end 96. The first end 94 of the actuating lever 18 may include a gripping device 98, such as a handle, knob or the like. The second end 96 of the actuating lever 18 may include a cam lobe 100 defining a cam edge 102 and pin hole 104, wherein the pin hole 104 may be spaced a predetermined distance away from the cam edge 102. Those skilled in the art will appreciate that the spacing between the cam edge 102 and the pin hole 104 (i.e., the pivot point) may be selected based upon the desired movement of the jaws 30, 60.

Still referring to FIG. 2, the biasing element 20 may be a coil spring 104 and may include a first end 106 and a second end 108. However, at this point, those skilled in the art will appreciate that biasing devices other than coil springs may used without departing from the scope of the present disclosure. For example, the biasing element 20 may be a leaf spring, a torsion spring or the like. Furthermore, those skilled in the art will appreciate that while only a single biasing element 20 is shown in FIGS. 1 and 2, a second biasing element may be connected to the clamp 10 using spring connection posts 38, 68.

Figure 6:
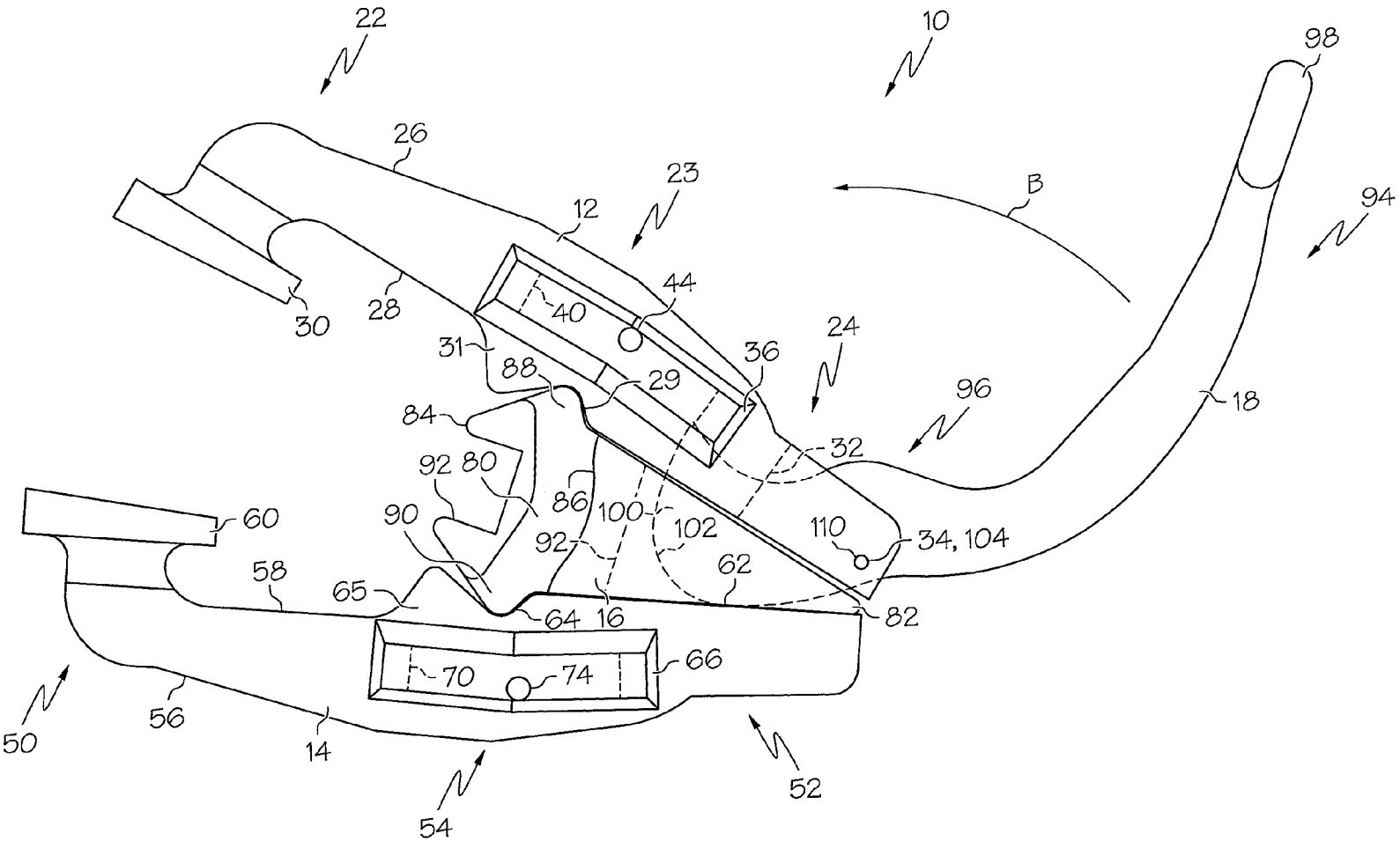
FIG. 6 is a side elevational view of the cam actuated clamp of FIG. 1 shown in a disengaged configuration (the biasing element is not shown)

Referring to FIG. 6, the clamp 10 may be partially assembled by positioning the edge pusher 16 between the upper body 12 and the lower body 14. In particular, the proximal end 82 of the edge pusher 16 may be positioned between the proximal ends 24, 52 of the upper 12 and lower 14 bodies such that the upper pivot projection 88 is received in the upper fulcrum 29 and the lower pivot projection 90 is received in the lower fulcrum 64.

Then, the cam lobe 100 of the actuating lever 18 may be positioned in the notch 32 formed in the proximal end 24 of the upper body 12 and the notch 92 formed in the proximal end 82 of the edge pusher 16 such that the pin hole 34 in the proximal end 24 of the upper body 12 is aligned with the pin hole 104 in the actuating lever 18, thereby positioning the cam edge 102 of the actuating lever 18 for engagement with the cam surface 62 of the lower body 14. A rod 110, or other like device (e.g., screw, pin or the like), may be inserted through the pin holes 34, 104 in the upper body 12 and the actuating lever 18 to secure the upper body 12 to the actuating lever 18.

Referring to FIG. 1, assembly of the clamp 10 may be completed when the first end 106 of the coil spring 104 is positioned in the slot 40 in the spring connection post 36 of the upper body 12 and the second end 108 of the coil spring 104 is positioned in the slot 70 in the spring connection post 66 of the lower body 14. Rods 112, 114, or other like device (e.g., screw, pin or the like), may be inserted through the pin holes 44, 74 in the spring connection posts 36, 66 to secure the ends 106, 108 of the coil spring 104 to the respective upper 12 and lower 14 bodies. The coil spring 104 may connect the lower body 14 to the upper body 12, the edge pusher 16 and the actuating lever 18, and may provide tension between the upper 12 and lower 14 bodies, thereby biasing the clamp 10 to the open, disengaged configuration shown in FIG. 6. A second coil spring (not shown) may be connected to the second spring connection posts 38, 68 in a similar manner.

Accordingly, the jaws 30, 60 of the clamp 10 may be approximated against the bias of the coil spring 104 by moving the actuating lever 18 in the direction shown by arrow B (FIG. 6). As the actuating lever 18 moves in the direction of arrow B, the cam edge 102 of the lever 18 cams along the cam surface 62 of the lower body 14, thereby displacing the proximal end 24 of the upper body 12 relative to the proximal end 52 of the lower body 14, which in turn causes the upper body 12 to pivot relative to the edge pusher 16 at the upper fulcrum 29 and the lower body to pivot relative to the edge pusher 16 at the lower fulcrum 64, thereby approximating the upper 30 and lower 60 jaws. (Compare FIGS. 6 and 1.) Therefore, the clamp 10 may be used to apply a clamping force to a workpiece positioned between the jaws 30, 60.

Furthermore, as shown in FIG. 1, the position of the coil spring 104 relative to the edge pusher 16 may cause the coil spring 104 to conform around the rear face 86 of the distal end 80 of the edge pusher 16, thereby applying a force to the edge pusher 16 in the direction shown by arrow F. The ramped portion 31 of the upper fulcrum 29 and the ramped portion 65 of the lower fulcrum 64 may counteract this force, thereby maintaining static equilibrium.

Figure 7:
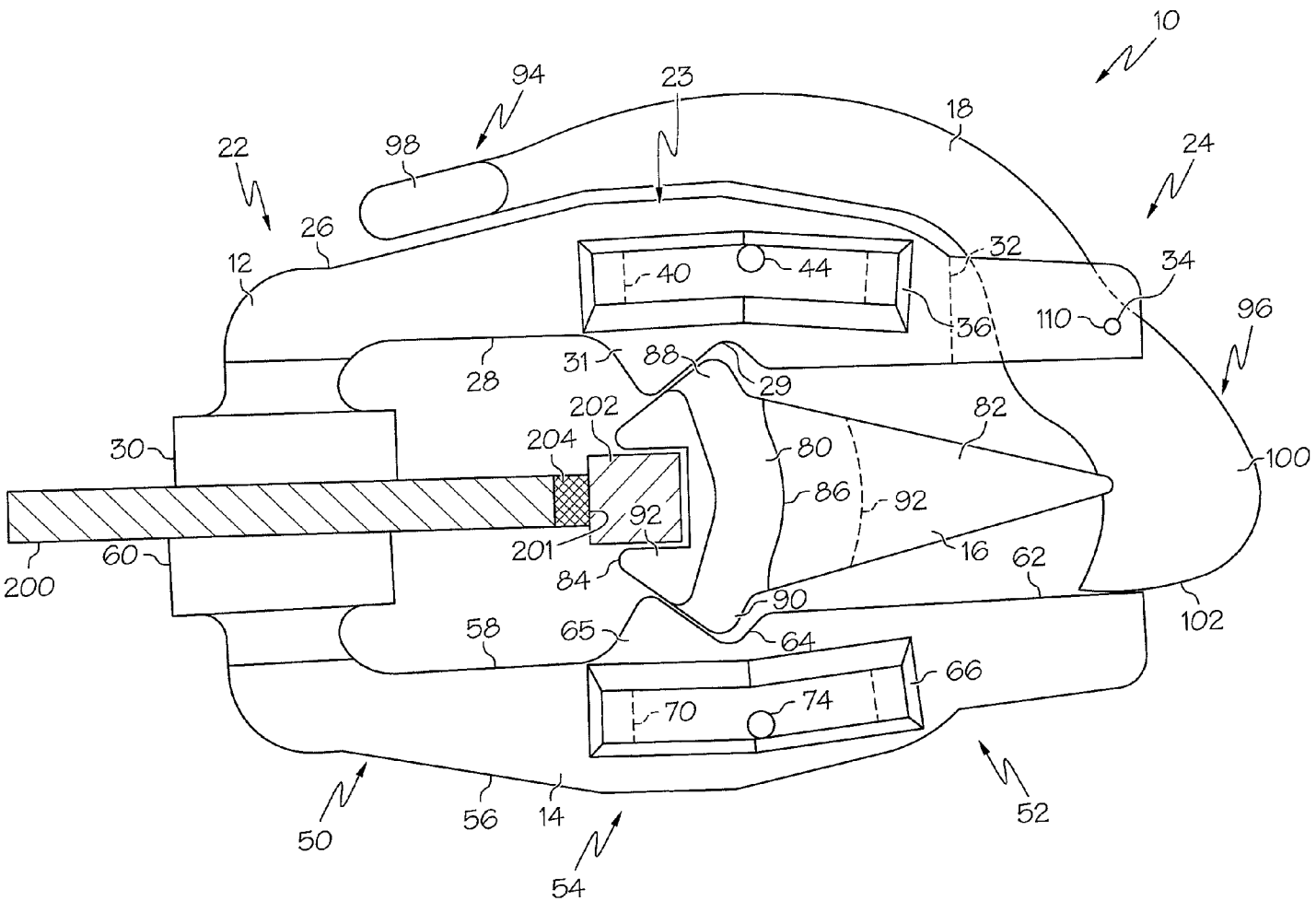
FIG. 7 is a side elevational view of the cam actuated clamp of FIG. 6 provided with a straight edge and shown engaging a workpiece (the biasing element is not shown).

However, referring to FIG. 7, when a workpiece 200 is positioned between the jaws 30, 60, the jaws 30, 60, and associated upper 12 and lower 14 bodies, are slightly displaced (i.e., the jaws 30, 60 are further separated than they are in the configuration shown in FIG. 1). This displacement slightly displaces the upper 88 and lower 90 pivot projections from the upper 29 and lower 64 fulcrums, thereby allowing the force of the coil spring 104 (arrow F in FIG. 1) to drive the edge pusher 16 in the distal direction along the ramped portions 31, 65, as shown in FIG. 7. As the edge pusher 16 is urged in the distal direction, the edge pusher 16 may apply a pushing force to the edge 201 of the trim 204 of the workpiece 200 in a direction generally perpendicular to the direction of the applied clamping force.

While the edge pushing feature of the clamp 10 described above is optional, those skilled in the art will appreciate that the edge pushing feature may be achieved by designing the clamp 10 such that the edge pusher 16, particularly the rear face 86 of the edge pusher 16, interferes with the coil spring 104 such that the coil spring 104 applies a pushing force thereto. In particular, a pushing force in the direction of arrow F can be achieved by selectively positioning the upper and lower fulcrums 29, 64 or extending the rear face 86 of the edge pusher 16, among other ways.

Accordingly, the disclosed clamp 10 uses a simple lever action to apply a clamping force to a workpiece, thereby reducing application time and minimizing the effort required to close the clamp 10. In particular, those skilled in the art will note that the clamp 10 may be actuated using only one hand. Furthermore, the disclosed clamp 10 may be configured such that the edge pusher 16 applies a pushing force capable of urging a first body (e.g., plastic trim) into contact with the edge of a workpiece (e.g., an interior panel of an airplane). The clamping force and the pushing force may be applied simultaneously and in a single action (i.e., movement of the actuating lever 18).

Although various aspects of the disclosed cam actuated clamp have been shown and described, modifications may occur to those skilled in the art upon reading the specification. The present application includes such modifications and is limited only by the scope of the claims.

What is claimed is:

1. A clamp comprising:

an upper body including a proximal end, a distal end, and an upper fulcrum, said upper fulcrum being positioned between said proximal end and said distal end of said upper body, wherein said distal end of said upper body includes an upper jaw;

a lower body including a proximal end, a distal end, and a lower fulcrum, said lower fulcrum being positioned between said proximal end and said distal end of said lower body, wherein said distal end of said lower body includes a lower jaw;

an edge pusher having an upper projection pivotally engaged with said upper fulcrum and a lower projection pivotally engaged with said lower fulcrum;

an actuating lever pivotally connected to said upper body, said actuating lever including a cam lobe moveable relative to said lower body to displace said proximal end of said lower body away from said proximal end of said upper body; and a biasing element positioned to bias said upper jaw away from said lower jaw.

2. The clamp of claim 1 wherein said upper body is independent of said lower body.

3. The clamp of claim 1 wherein said edge pusher is independent of said upper body and said lower body.

4. The clamp of claim 1 wherein said proximal end of said upper body includes a notch and at least a portion of said actuating lever is received in said notch.

5. The clamp of claim 1 wherein said proximal end of said upper body includes a first notch and said edge pusher includes a second notch, wherein at least a portion of said actuating lever is moveable through said first notch and said second notch.

6. The clamp of claim 1 wherein said biasing element is connected to said upper body and said lower body.

7. The clamp of claim 1 wherein said biasing element is a coil spring.

8. The clamp of claim 7 wherein said upper body includes a first spring connection post and said lower body includes a second spring connection post, and wherein a first end of said coil spring is connected to said first spring connection post and a second end of said coil spring is connected to said second spring connection post.

9. The clamp of claim 1 wherein said edge pusher includes a front face and a rear face, wherein said biasing element applies a pushing force to said rear face of said edge pusher.

10. The clamp of claim 1 wherein said front face includes a notch and a straightedge received in said notch.

11. The clamp of claim 1 wherein said upper fulcrum is formed as a channel and said upper projection is formed as a ridge.

12. The clamp of claim 1 wherein said upper fulcrum includes a first ramped portion positioned at a distal side of said upper fulcrum and said lower fulcrum includes a second ramped portion positioned at a distal side of said lower fulcrum.

13. The clamp of claim 1 wherein said proximal end of said lower body includes a cam surface and said cam lobe is positioned to cam along said cam surface.

14. The clamp of claim 1 wherein said actuating lever includes a gripping device.

15. A clamp comprising:

an upper body including a proximal end, a distal end, and an upper fulcrum, said upper fulcrum being positioned between said proximal end and said distal end of said upper body, wherein said distal end of said upper body includes an upper jaw;

a lower body including a proximal end, a distal end, and a lower fulcrum, said lower fulcrum being positioned between said proximal end and said distal end of said lower body, wherein said distal end of said lower body includes a lower jaw;

an edge pusher having an upper projection and a lower projection, said upper projection being pivotally engaged with said upper fulcrum and said lower projection being pivotally engaged with said lower fulcrum;

an actuating lever pivotally connected to said upper body, said actuating lever including a cam lobe moveable relative to said lower body to displace said proximal end of said lower body away from said proximal end of said upper body; and a coil spring connected to said upper body and said lower body to bias said upper jaw away from said lower jaw, wherein said coil spring applies a pushing force to said edge pusher when said proximal end of said lower body is displaced away from said proximal end of said upper body.

16. The clamp of claim 15 wherein said edge pusher includes a front face and a rear face, wherein said coil spring engages said rear face when said proximal end of said lower body is displaced away from said proximal end of said upper body.

17. The clamp of claim 16 wherein said rear face is curved.

18. The clamp of claim 15 wherein said upper jaw and said lower jaw apply a clamping force when said proximal end of said lower body is displaced away from said proximal end of said upper body.

19. The clamp of claim 18 wherein said clamping force is applied in a direction that is substantially perpendicular to a direction that said pushing force is applied, and wherein said clamping force is applied simultaneously with said pushing force.

20. A clamp comprising:

an upper body including a proximal end, a distal end, an upper fulcrum and an upper spring connection post, said upper fulcrum having a first ramped portion and being positioned between said proximal end and said distal end of said upper body, wherein said distal end of said upper body includes an upper jaw, wherein said proximal end of said upper body includes a first notch;

a lower body independent of said upper body, said lower body including a proximal end, a distal end, a lower fulcrum and a lower spring connection post, said proximal end of said lower body defining a cam surface, said lower fulcrum including a second ramped portion and being positioned between said proximal end and said distal end of said lower body, wherein said distal end of said lower body includes a lower jaw;

an edge pusher independent of said upper body and said lower body, said edge pusher including a front face, a rear face, an upper projection, a lower projection and a second notch, said upper projection being pivotally engaged with said upper fulcrum and said lower projection being pivotally engaged with said lower fulcrum;

an actuating lever pivotally connected to said upper body such that at least a portion of said actuating lever is moveable through said first notch and said second notch, said actuating lever including a cam lobe moveable relative to said cam surface to displace said proximal end of said lower body away from said proximal end of said upper body; and a coil spring having a first end and a second end, said first end being connected to said upper connection post and said second end being connected to said lower connection post, wherein said coil spring applies a pushing force to said rear face of said edge pusher when said proximal end of said lower body is displaced away from said proximal end of said upper body.

21. A method for securing a first body against an edge of a second body using a clamp, said clamp including an upper jaw, a lower jaw, an edge pusher and a lever, said method comprising the steps of:

positioning said second body between said upper jaw and said lower jaw of said clamp;

positioning said first body between said edge of said second body and said edge pusher of said clamp; and actuating said lever such that said upper jaw and said lower jaw approximate to apply a clamping force to said second body, while, simultaneously, said edge push is advanced to apply a pushing force to said first body.

22. The method of claim 21 wherein said first body is a piece of trim.

23. The method of claim 21 wherein said second body is an interior panel of an aircraft.

24. The method of claim 21 wherein said pushing force is applied in a direction perpendicular to said clamping force.

* * * * *